US006454526B1

(12) United States Patent
Cunha et al.

(10) Patent No.: US 6,454,526 B1
(45) Date of Patent: Sep. 24, 2002

(54) COOLED TURBINE VANE WITH ENDCAPS

(75) Inventors: Frank J. Cunha, Avon, CT (US); Anthony L. Schiavo, Jr., Ovideo, FL (US); Raymond Scott Nordlund, Orlando, FL (US); Thomas Malow, Oviedo, FL (US); Barry L. McKinley, Chuluota, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/672,592

(22) Filed: Sep. 28, 2000

(51) Int. Cl.[7] ..... F01D 25/08
(52) U.S. Cl. ..... 415/115
(58) Field of Search ..... 416/95, 97 R, 416/96 R; 415/115, 178

(56) References Cited

U.S. PATENT DOCUMENTS

| | | | | | |
|---|---|---|---|---|---|
| 3,807,892 | A | * | 4/1974 | Frei et al. | 415/115 |
| 4,283,822 | A | * | 8/1981 | Muth et al. | 415/115 |
| 4,288,201 | A | * | 9/1981 | Wilson | 415/115 |
| 4,314,442 | A | * | 2/1982 | Rice | 415/115 |
| 5,120,192 | A | * | 6/1992 | Ohtomo et al. | 415/115 |
| 5,246,340 | A | * | 9/1993 | Winstanley et al. | 415/115 |
| 5,320,483 | A | | 6/1994 | Cunha et al. | |
| 5,340,274 | A | | 8/1994 | Cunha | |
| 5,711,650 | A | * | 1/1998 | Tibbott et al. | 415/115 |
| 5,743,708 | A | | 4/1998 | Cunha et al. | |
| 5,829,245 | A | * | 11/1998 | McQuiggan et al. | 415/115 |
| 5,913,658 | A | | 6/1999 | Sexton et al. | |
| 5,953,900 | A | | 9/1999 | Bannister et al. | |
| 6,019,572 | A | | 2/2000 | Cunha | |
| 6,261,054 | B1 | | 7/2001 | Bunker et al. | |

FOREIGN PATENT DOCUMENTS

| | | |
|---|---|---|
| EP | 0911489 | 4/1999 |

* cited by examiner

*Primary Examiner*—Edward K. Look
*Assistant Examiner*—Igor Kershteyn

(57) ABSTRACT

A turbine vane assembly which includes an outer endcap having a plurality of generally straight passages and passage segments therethrough, an inner endcap having a plurality of passages and passage segments therethrough, and a vane assembly having an outer shroud, an airfoil body, and an inner shroud. The outer shroud, airfoil body and inner shroud each have a plurality of generally straight passages and passage segments therethrough as well. The outer endcap is coupled to the outer shroud so that outer endcap passages and said outer shroud passages form a fluid circuit. The inner endcap is coupled to the inner shroud so that the inner end cap passages and the inner shroud passages from a fluid circuit. Passages in the vane casting are in fluid communication with both the outer shroud passages and the inner shroud passages. Passages in the outer endcap may be coupled to a cooling system that supplies a coolant and takes away the heated exhaust.

38 Claims, 5 Drawing Sheets

COOLED TURBINE VANE WITH ENDCAPS

GOVERNMENT CONTRACT

The Government of the United States of America has certain rights in this invention pursuant to Contract No. DE-FC21-95MC32267 awarded by the U.S. Department of Energy.

BACKGROUND OF THE INVENTION

1. Field of the Invention

This invention relates to a combustion turbine vane assembly, and more specifically, to a combustion turbine vane assembly having endcaps for directing the flow of a coolant, and an associated method of manufacture and assembly of the vane assembly.

2. Background Information

Combustion turbine, generally, have three main assemblies: a compressor assembly, a combustor assembly, and a turbine assembly. In operation, the compressor assembly compresses ambient air. The compressed air is channeled into the combustor assembly where it is mixed with a fuel. The fuel and compressed air mixture is ignited creating a heated working gas. The heated working gas is typically at a temperature of between 2500 to 2900° F. (1371 to 1593° C). The working gas is expanded through the turbine assembly. The turbine assembly includes a plurality of stationary vane assemblies and rotating blades. The rotating blades are coupled to a central shaft. The expansion of the working gas through the turbine section forces the blades to rotate creating a rotation in the shaft.

Typically, the turbine assembly provides a means of cooling the vane assemblies. The first row of vane assemblies, which typically precedes the first row of blades in the turbine assembly, is subject to the highest temperature of working gas. To cool the first row of vane assemblies, a coolant, such as steam or compressed air, is passed through passageways formed within the vane structure. These passageways often include an opening along the trailing edge of the vane to allow the coolant to join the working gas. Such an "open loop" system has the disadvantage of reducing the energy of the working gas available to do useful work.

"Closed loop" systems allow a coolant to flow through the vane, cooling the vane and absorbing heat, and returning the coolant to be used elsewhere. For example, when the coolant is steam, cool steam is supplied to the vane assemblies and the heated steam may be directed to a steam turbine assembly which is coupled to the closed loop.

An effective closed loop vane cooling design uses a plurality of cooling passages. Prior art closed loop vane assemblies use complicated castings to form the passages. These complex castings, however, have resulted in low manufacturing yields. That is, there is a high rejection rate of the castings during the manufacturing process. The complex casting also required a complex manufacturing process to assemble each vane assembly.

There is, therefore, a need for a turbine vane assembly structured to have a closed loop cooling system which does not require a complicated casting.

There is a further need for a turbine vane structured to have a closed loop cooling system which is easy to assemble.

There is a further need for a turbine vane structure to have a closed loop cooling system which may be easily manufactured.

SUMMARY OF THE INVENTION

These needs, and others, are satisfied by the invention which provides a turbine vane assembly having an outer endcap, an inner endcap, and a vane casting with an outer shroud, an inner shroud, and an airfoil. The outer endcap, the inner endcap, the outer shroud, the inner shroud, and the airfoil, which may be jointly called "the components," each have a plurality of generally straight passageways therethrough which are structured to carry a cooling fluid in a closed loop. Because the passages are generally straight, the passages may be drilled in the components after casting Because the generally straight passageways can be drilled, for example by electro-discharge machining ("EDM") or electrochemical machining ("ECM"), the vane assemblies and endcaps do not require a complicated casting.

The outer endcap casting includes an inlet port, for allowing a coolant to enter the vane assembly, and an exhaust port, which allows the heated coolant to be routed from the vane assembly to perform useful work elsewhere. The inner endcap casting includes a coolant inlet port. The vane casting includes an integral outer shroud, airfoil, an inner shroud. The outer shroud and inner shroud are structured to be mated with the outer endcap and the inner endcap respectively. When mated, both the inner endcap and the outer endcap form a plurality of plenums with their respective shrouds. The airfoil is essentially hollow, having a main coolant passage and at least one exhaust passage. The plurality of generally straight passages structured to cool the vane assembly are in fluid communication with the outer endcap coolant inlet port and exhaust port. The generally straight passageways within the components are structured to cooperate with the plurality of plenums to create a closed loop cooling system.

Manufacture and assembly of the vane assemblies begins with the casting of the end caps and vane casting. The outer endcap is cast with a coolant inlet port and an exhaust port. The vane casting includes a generally hollow airfoil having a main coolant passage and at least one main exhaust passage. A plurality of openings are machined into the vane casting outer shroud and inner shroud using EDM or ECM. Plugs, machined using wire EDM, are made to partially fill the openings. The cooling passages are then drilled in the components using EDM or ECM. The plugs are inserted into the shroud openings forming the shroud edge plenums. A bond coat is then applied to the components. The bond coat resists oxidation and acts as a bonding layer for the thermal barrier coating which is applied subsequently. The mating surfaces between the endcaps and the vane casting are then machined using conventional machining techniques. Additionally, other features, such as seal slots, end face joints, and shroud hook grooves, may be machined on the components. The endcaps are then heated and fitted into the shrouds forming an interference fit. The interference fit seals the plenums from each other. The joining of the endcaps to the shrouds creates a plurality of plenums in both the outer shroud and the inner shroud. The vane assembly then has a thermal barrier coating applied. Preferably, the airfoil has the coating applied first, then the shrouds and endcaps. Next, an internal aluminized steam corrosion protection is applied.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENT

Figure 1:
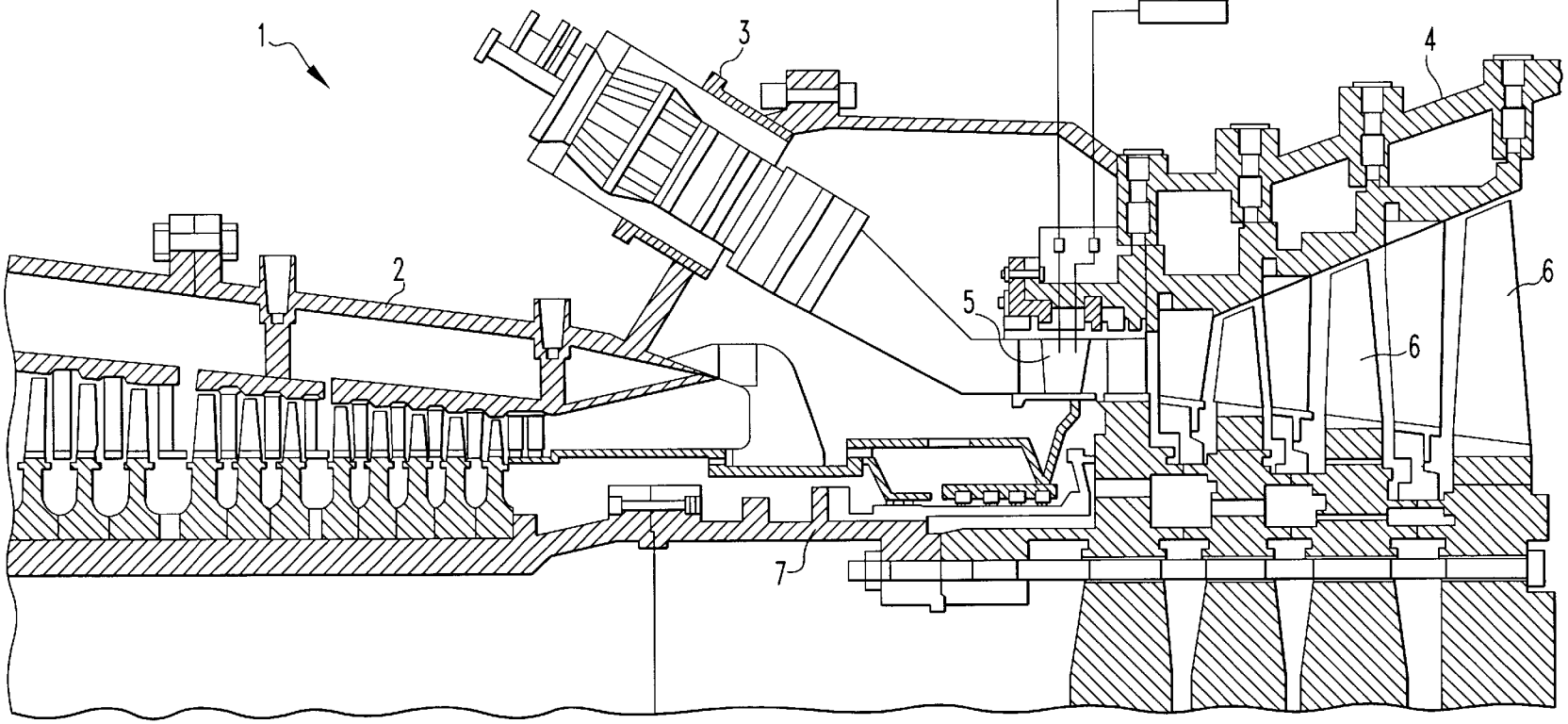
FIG. 1 is a cross sectional view of a combustion turbine.

As shown in FIG. 1, a combustion turbine 1 has a compressor assembly 2, a combustor assembly 3, and a turbine assembly 4. In operation, the compressor assembly 2 compresses ambient air. The compressed air is channeled into the combustor assembly 3 where it is mixed with a fuel. The fuel and compressed air mixture is ignited creating a heated working gas. The heated working gas is typically at a temperature of between 2500 to 2900° F. (1371 to 1593° C.). The working gas is expanded through the turbine assembly 4. The turbine assembly 4 includes a plurality of stationary vane assemblies 5 and rotating blades 6. The rotating blades 6 are coupled to a central shaft 7. The expansion of the working gas through the turbine assembly 4 forces the blades 6 to rotate creating a rotation in the shaft 7. A cooling system 8 is structured to supply a coolant, such as, but not limited to, steam or compressed air to the vane assemblies 5 and blades 6. The cooling system 8 is also structured to receive the used, or heated, coolant from the vane assemblies 5 and blades 6.

Figure 2:
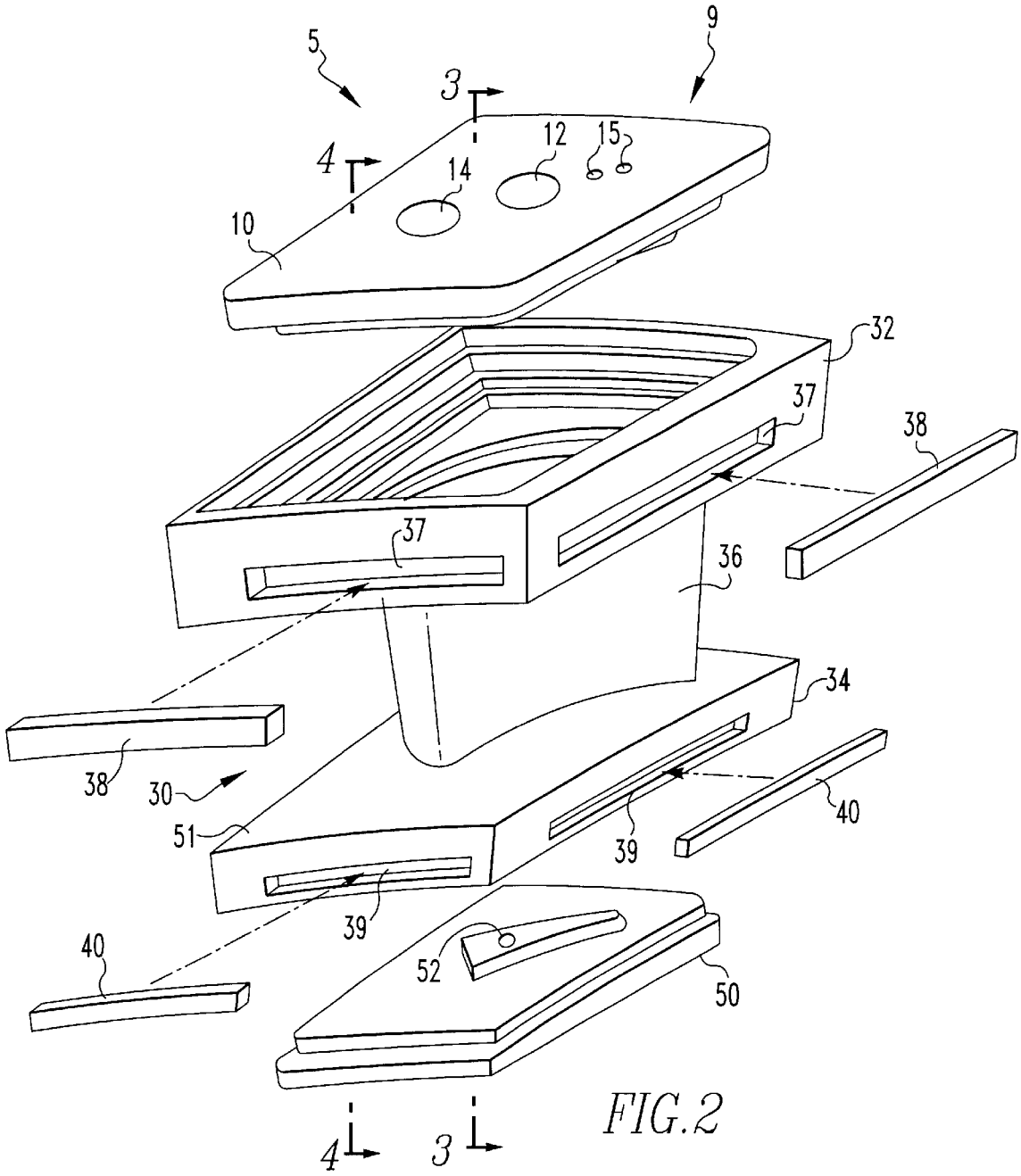
FIG. 2 is an explored isometric view of the vane.

As shown on FIG. 2, a vane assembly 5 includes an outer endcap 10, a vane casting 30 and an inner endcap 50. The vane casting 30 includes an outer shroud 32, an inner shroud 34, and an airfoil 36. The outer shroud 32 and inner shroud 34 each have and inner face 31 (FIG. 3), 51 respectively, which is in direct contact with the working gas. The outer endcap 10 is structured to be coupled to the cooling system 8 (FIG. 1) by a coolant inlet port 12 and an exhaust port 14. The inner endcap 50 has a coolant inlet port 52. The outer shroud 32 has a plurality of edge plenum openings 37 and edge plenum plugs 38. The inner shroud 34 also includes a plurality of edge plenum openings 39 and edge plenum plugs 40.

Figure 3:
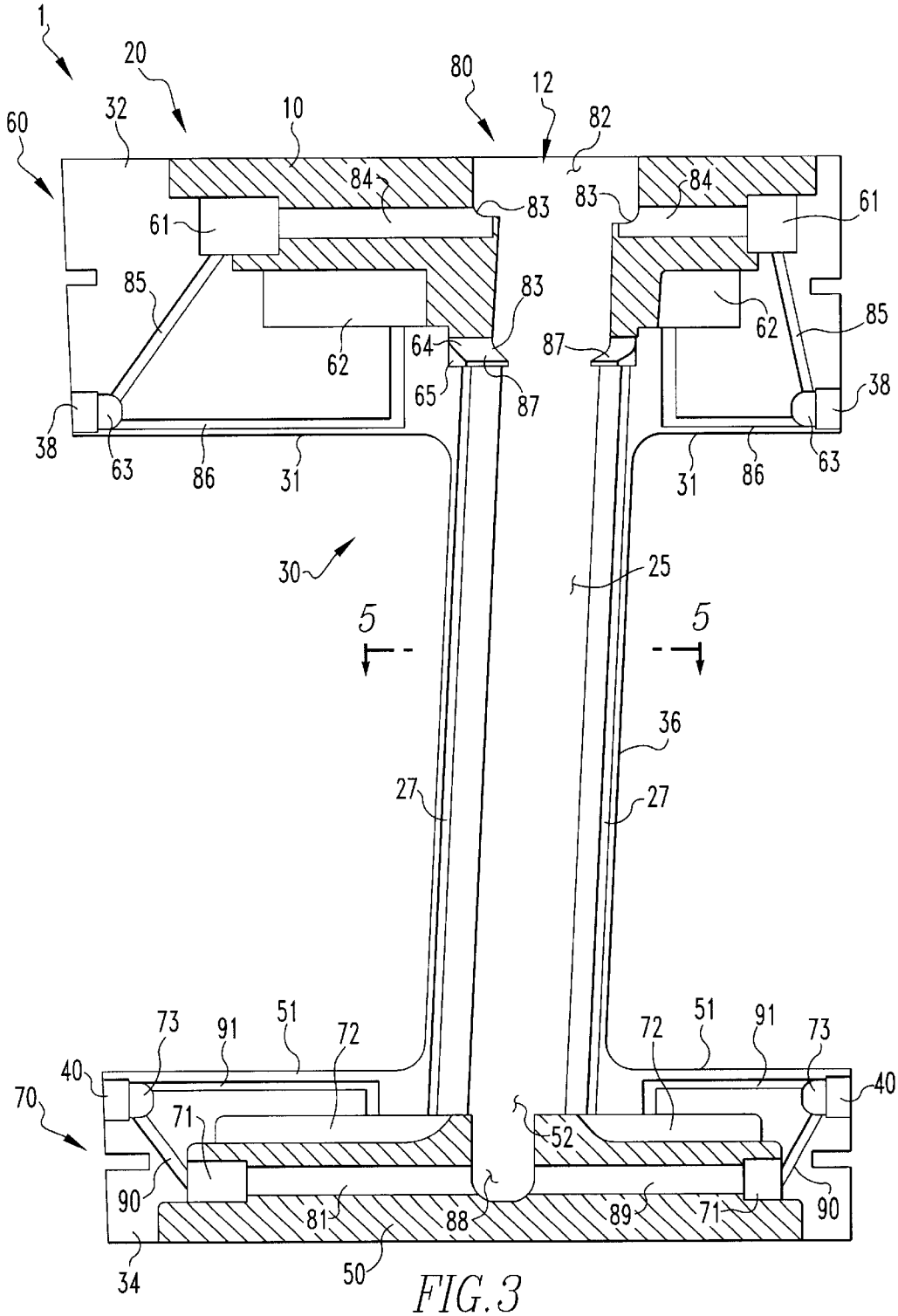
FIG. 3 is a cross sectional view taken along line 3—3 of FIG. 2.
Figure 4:
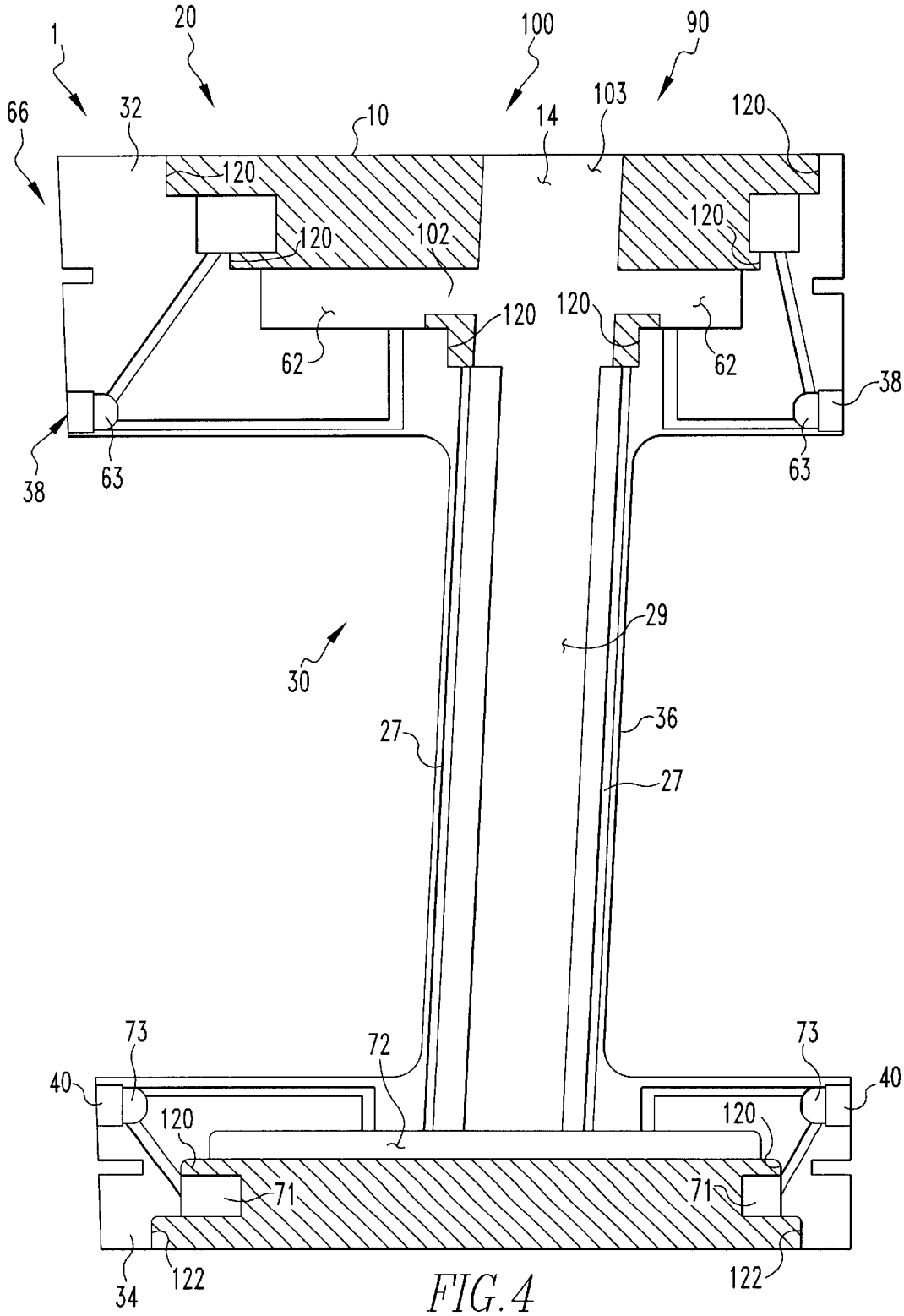
FIG. 4 is a cross section view taken along line 4—4 of FIG. 2.

As shown in FIGS. 3 and 4, the outer endcap 10, vane casting 30, and inner endcap 50 each have a plurality of generally straight passages and passage segments therein 20. The outer endcap 10 is structured to be coupled to the outer shroud 32 by an interference fit. Coupling the outer endcap 10 to the outer shroud 32 forms a plurality of outer shroud plenums 60. The outer shroud plenums 60 include a first plenum 61, a second plenum 62 and a third plenum 64. An outer shroud edge plenum 63 is also located on the outer shroud 32. The outer shroud edge plenum 63 is formed by plug 38 being inserted in opening 37 (FIG. 1).

The inner endcap 50 is structured to be coupled to the inner shroud 34 by an interference fit. Coupling the inner endcap 50 to the inner shroud 34 forms a plurality of inner shroud plenums 70. The inner shroud plenums 70 include a fourth plenum 71, and a fifth plenum 72. An inner shroud edge plenum 73 is also located on the inner shroud 34. The inner shroud edge plenum 73 is formed by plug 40 being inserted in opening 39 (FIG. 1).

Figure 5:
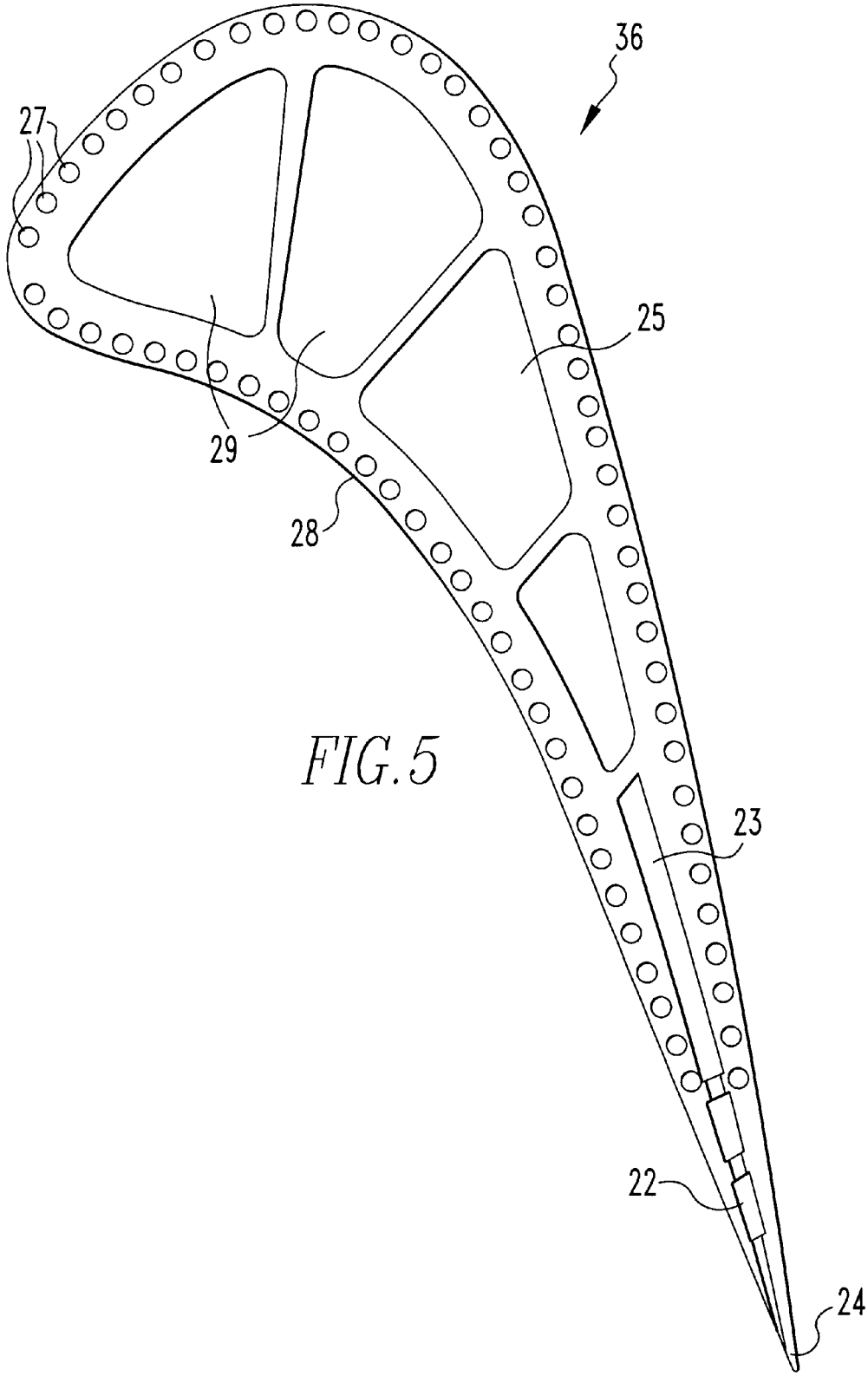
FIG. 5 is a cross sectional view taken along line 5—5 of FIG. 3.

Vane casting airfoil 36 includes a plurality of main passageways 25 (FIG. 3), 29 (FIG. 4) and generally straight cooling passageways 27. As shown most clearly in FIG. 5, the cooling passages 27 extend through the airfoil adjacent to an airfoil outer surface 28. The cooling passages 27 may be turbulated to aid in heat transfer. The airfoil 36 further includes an airfoil coolant main passageway 25 and at least one airfoil exhaust main passageway 29. The airfoil 36 may also include cooling passages 23 for an open loop or closed loop cooling system for cooling the trailing edge 24. The cooling passages 27 are in fluid communication with both the third plenum 64 and the fifth plenum 72.

The coolant circuit formed by the plurality of passageways 20 and plenums 60, 63, 70, 73 includes a cooling circuit 80, depicted in FIG. 3, and an exhaust circuit 90 depicted in FIG. 4. The cooling circuit, shown in FIG. 3, begins with a coolant being supplied through coolant inlet port 12 and the outer endcap 10. Coolant inlet port 12 is coupled to a main coolant inlet passage 82. The main coolant inlet passage 82 is in fluid communication with a plurality of outer endcap first passages 84 which extend to and are in fluid communication with first plenum 61. Preferably, the passages of the plurality of outer endcap first passages 84 each have a diameter between about 0.4 and 0.6 inches (1.0 to 1.5 cm). Each passage of the plurality of outer endcap first passages 84 may have a lip 83 that aids in deflecting a coolant into the passages 84. Preferably, the plurality of outer endcap first passages 84 form a pattern, such as a spoke-like pattern, extending from the main coolant inlet passage 82 to the first plenum 61. The outer shroud 32 includes a plurality of first passages 85 which extend between and are in fluid communication with first plenum 61 and outer shroud edge plenum 63. The passages of the plurality of outer shroud first passages 85 are disposed to provide a uniform flow to the outer shroud edge plenum 63.

The outer shroud 32 further includes a plurality of second passageways 86 which extend generally adjacent to outer shroud inner face 31. At a point proximal to airfoil 36, the plurality of outer shroud second passageways 86 each turn generally 90 degrees away from outer shroud inner face 31 and extend to and are in fluid communication with the second plenum 62. The passages of the plurality of outer shroud second passages 86 each have a diameter between about 0.06 and 0.12 inches (0.15 to 0.30 cm). The second plenum 62, as will be described below, is part of the exhaust circuit 90.

Outer endcap main coolant inlet passage 82 is in further fluid communication with the third plenum 64 through a second plurality of outer endcap passageways 87. The passages of the plurality of outer endcap second passages 87 each have a diameter between about 0.08 and 0.12 inches (0.20 to 0.30 cm). The third plenum 64 is in fluid communication with airfoil passages 27 and may include dividers 65 which direct a set amount of coolant flow to the airfoil passages 27. The airfoil passages 27 are in further communication with the fifth plenum 72. The fifth plenum 72, as will be described below, is part of the exhaust circuit 90.

The outer endcap main coolant inlet passage 82 is in further communication with airfoil main coolant passageway 25. The airfoil main coolant passageway 25 is in fluid communication with inner endcap inlet 52. The inner endcap inlet 52 is in fluid communication with a inner endcap main coolant passage 88. Inner endcap main coolant passage 88 is in fluid communication with a plurality of inner endcap first passages 89 which extend outwardly from inner endcap main coolant passage 88. Preferably, the plurality of inner endcap first passages 89 extend in a spoke-like pattern away from inner endcap main coolant passage 88. The plurality of inner endcap first passages 89 are in fluid communication with the fourth plenum 71. The inner shroud 34 includes a plurality of first passageways 90 which extend between and are in fluid communication with fourth plenum 71 and inner shroud, edge 73. The inner shroud further includes a plurality of second passageways 91 which are in fluid communication with the inner shroud, edge plenum 73 and the fifth plenum 72. The plurality of inner shroud second passages 91 extend adjacent to inner shroud inner face 51. At a point proximal to airfoil 36, the inner shroud plurality of second passageways each turn approximately 90 degrees away from the inner shroud inner face 51 and are in fluid communication with the fifth plenum 72.

As shown in FIG. 4, the exhaust circuit 100 includes the fifth plenum 72 which is in fluid communication with airfoil main exhaust passage 29. The outer endcap 10 includes a passageway 102 between the second plenum 62 and a main exhaust passage 103. Main exhaust passage 103 is also in fluid communication with airfoil main exhaust passage 29. Outer endcap main exhaust passage 103 is in further fluid communication with exhaust outlet port 14.

As shown in FIG. 2, the coolant system may also include an open-loop airfoil trailing edge coolant circuit 9. The airfoil trailing edge coolant circuit 9 includes at least one coolant inlet port 15 on endcap 10. This inlet port 15 is in fluid communication with passage 23 (FIG. 5) which extends through airfoil 36 adjacent to the trailing edge 24. Trailing edge 24 has a plurality of exhaust ports 22 (FIG. 5) which allow the coolant to exit the open loop and join the working gas.

In operation, a coolant, such as steam, air, or another fluid, is introduced by a cooling system 8 to a turbine vane assembly 5. The coolant enters the turbine vane assembly 1 through coolant inlet port 12. A portion of the coolant is directed by a lip 83 into the plurality of outer endcap first passages 84. The coolant travels into first plenum 61 where it is distributed through the plurality of outer shroud first passages 85 to outer shroud, edge plenum 63. The coolant than travels through outer shroud plurality of second passages 86, along the outer shroud inner face 31. The outer shroud plurality of second passages 86 returns the coolant, which has absorbed heat to second plenum 62. This heated coolant is returned through passages 102 to the outer endcap main exhaust channel 103 and exits the system through exhaust port 14.

A second portion of coolant which has entered outer endcap main coolant passage 82 travels through outer endcap second plurality of passages 87 into the third plenum 64. The coolant is directed by a lip 83 into the third plenum 64. Coolant within the third plenum 64 is delivered to the plurality of cooling channels 27 within the airfoil 36. The coolant absorbs heat as it travels towards the inner shroud 34 where the cooling channels 27 are in fluid communication with the fifth plenum 72. The fifth plenum 72 is in fluid communication with airfoil exhaust passage 29 which allows the heated coolant to exit through exhaust passage 103 and exhaust port 14.

A third portion of coolant which enters the outer endcap 10 through outer endcap main coolant passage 82 is delivered to airfoil main coolant passage 25. Coolant within the airfoil main coolant passage 25 is delivered through inner endcap inlet port 52 to the inner endcap main coolant passage 88. Coolant within the inner end cap main coolant passage,88 travels through the inner endcap first plurality of passages 89 to the fourth plenum 71. Coolant within the fourth plenum 71 travels through the inner shroud first plurality of passages 90 to the inner shroud edge plenum 73. The coolant is then delivered to the inner shroud, second plurality of passages 91, which extend along inner shroud face 51. These passages deliver the coolant to the fifth plenum 72. As noted before, the fifth plenum 72 is in fluid communication with airfoil main exhaust passage 29 which further allows the coolant to exit the vane assembly 1 through exhaust port 14. The exhaust port 14 returns the heated coolant to the cooling system 8.

As can be seen on FIGS. 3 and 4, individually the plurality of passageways through outer endcap 10, vane casting 30, and inner endcap 50 are generally straight or are comprised of straight segments. Such straight passageways may be formed by EDM or ECM drilling. As such, the outer endcap 10, the vane casting and the inner endcap 50 may be cast as a solid piece having the proper perimeter configuration but without having any passageway formed as part of the casting. For ease of manufacture, however, certain large passages, such as the outer shroud inlet port 12 and exhaust port 14, and inner shroud coolant inlet port 52 may be cast, rather than drilled. The outer shroud edge plenum 63 and inner shroud edge plenum 73 may be formed by removing a portion of the shrouds 32, 34 using ECM to form openings 37 and 39 (FIG. 2). The openings 37, 39 are partially filled with plugs 38, 40. Plugs 38, 40 may be cut to precise tolerances by using wire EDM.

Accordingly, the vane assembly 5 may be formed by casting the outer endcap 10, vane casting 30, and inner endcap 50 as generally solid bodies. The outer endcap main coolant passage 82, outer endcap first plurality of passages 84, and outer endcap second plurality of passages 87 are drilled in the outer endcap 10 by EDM or ECM drilling. The vane casting 30 may have openings 37, 39 cut by EDM at the location of the outer shroud edge plenum 63, and the inner shroud edge plenum 73. After the openings 37, 39 are cut, the outer shroud first plurality of passages 85, outer shroud second plurality of passages 86, inner shroud first plurality of passages 90 and inner shroud second plurality of passage 91 may be drilled using EDM or ECM. Additionally, the plurality of airfoil passages 27 may be formed using ECM. Inner endcap 50 may have inner endcap first passages 89 formed by EDM or ECM.

Construction of the vane assembly 5 continues with the plugs 38 being inserted into the outer shroud openings 37, thereby forming the outer shroud edge plenum 63. Additionally, the plugs 40 are inserted into the inner shroud openings 39, thereby forming the inner shroud edge plenums 73.

The internal surfaces of the endcaps 10, 50, as well as the internal surfaces of the vane casting 30 are then machined using conventional methods. Such conventional machining is applied to the grooves on the outer shroud and the end face joints of the inner and outer shrouds. Additionally, seal slots may be machined on the outer surface of the outer shroud and the inner shroud. Following the machining, the outer endcap 10 is joined with outer shroud 32. As shown on FIG. 4, this joining creates an interference fit at locations 120. As stated above, when outer endcap 10 is coupled with outer shroud 32, the first, second, and third plenums 61, 62, and 63 are formed. Similarly, inner endcap 50 is coupled to inner shroud 34 forming an interference fit at locations 122 and further forming the fourth and fifth plenums 71, 72. Following the joining of the endcaps 10, 50 to the vane casting 30, the vane assembly 5 has a thermal bond coating applied thereto. Preferably, the thermal bond coating is applied to the airfoil 36 first, then to the inner shroud/inner endcap 34, 50 and outer shroud/outer endcap 32, 10. The vane assembly 5 then has an internal aluminum coating applied thereto.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A combustion turbine vane assembly comprising:

an outer endcap having a plurality of generally straight cooling passages and passage segments therethrough;

an inner endcap having a plurality of generally straight cooling passages and passage segments therethrough;

a vane casting having an outer shroud, an airfoil, and an inner shroud;

said outer shroud, airfoil and inner shroud each having a plurality of generally straight cooling passages and passage segments and wherein all said straight cooling passages and passage segments are in fluid communication, wherein said airfoil cooling passages extend from said outer shroud to said inner shroud;

wherein said outer endcap is coupled to said outer shroud so that all said outer endcap cooling passages, said outer shroud cooling passages and airfoil cooling passages are in fluid communication; and said inner endcap is coupled to said inner shroud so that all said inner end cap cooling passages, said inner shroud cooling passages and airfoil cooling passages are in fluid communication.

2. The turbine vane assembly of claim 1, wherein:

said outer endcap is structured to form a plurality of outer shroud plenums when said outer end cap is coupled to said outer shroud; and said outer shroud plenums are in fluid communication with said outer endcap passages and said outer shroud passages.

3. The turbine vane assembly of claim 2, wherein:

said inner endcap is structured to form a plurality of inner shroud plenums when said inner end cap is coupled to said inner shroud; and said inner shroud plenums are in fluid communication with said inner endcap passages and said inner shroud passages.

4. The turbine vane assembly of claim 3, wherein said outer endcap includes a main coolant inlet port and at least one main coolant exhaust port.

5. The turbine vane assembly of claim 4, wherein said inner endcap includes a main coolant inlet port.

6. The turbine vane assembly of claim 5, wherein:

said airfoil includes a main coolant passage and at least one main exhaust passage;

said airfoil main coolant passage in fluid communication with said outer endcap main coolant inlet port;

said airfoil main coolant passage coupled to said inner endcap main coolant inlet port;

said airfoil at least one main exhaust passage in fluid communication with said outer endcap main exhaust port.

7. The turbine vane assembly of claim 6, wherein:

said coupling of said outer endcap to said outer shroud creates a first plenum, a second plenum, and a third plenum;

said plurality of outer endcap passages and passage segments includes a plurality of outer endcap first passages in fluid communication with said outer endcap main coolant inlet port and said first plenum;

said plurality of outer shroud passages and passage segments includes a plurality of outer shroud first passages, an edge plenum, a plurality of outer shroud second passages, and an inner face;

said plurality of outer shroud first passages in fluid communication with said first plenum and said outer shroud edge plenum;

said plurality of outer shroud second passages in fluid communication with said outer shroud edge plenum and said second plenum, and extending along substantially all of said outer shroud inner face.

8. The turbine vane assembly of claim 7, wherein:

said plurality of outer endcap first passages each have a lip; and said lip structured to direct a portion of coolant from said outer endcap main coolant inlet port into said plurality of outer endcap first passages.

9. The turbine vane assembly of claim 8, wherein:

said coupling of said inner endcap to said inner shroud creates a fourth and fifth plenum;

said plurality of inner endcap passages and passage segments includes a plurality of inner endcap first passages in fluid communication with said inner endcap main coolant inlet port and said fourth plenum;

said plurality of inner shroud passages and passage segments includes a plurality of inner shroud first passages, an inner shroud edge plenum, a plurality of inner shroud second passages, and an inner face;

said plurality of inner shroud first passages in fluid communication with said fourth plenum and-said inner shroud edge plenum; and said plurality of inner shroud second passages in fluid communication with said inner shroud edge plenum and said fifth plenum, and extending along substantially all of said inner shroud inner face.

10. The turbine vane assembly of claim 9, wherein:

said third plenum is disposed adjacent to said airfoil;

said third plenum having inlets allowing fluid communication between said outer endcap main coolant inlet port and said third plenum;

said airfoil having an outer surface and cooling passages extending adjacent to said outer surface; and said airfoil cooling passages in fluid communication with said third plenum and said fifth plenum.

11. The turbine vane assembly of claim 10, wherein:

said fifth plenum is in fluid communication with said outer endcap exhaust port; and said second plenum is in fluid communication with said outer endcap exhaust port.

12. The turbine vane assembly of claim 7, wherein:

said coupling of said inner endcap to said inner shroud creates a fourth and fifth plenum;

said plurality of inner endcap passages and passage segments includes a plurality of inner endcap first passages in fluid communication with said inner endcap main coolant inlet port and said fourth plenum;

said plurality of inner shroud passages and passage segments includes a plurality of inner shroud first passages, an inner shroud edge plenum, a plurality of inner shroud second passages, and an inner face;

said plurality of inner shroud first passages in fluid communication with said fourth plenum and said inner shroud edge plenum; and said plurality of inner shroud second passages in fluid communication with said inner shroud edge plenum and said fifth plenum, and extending along substantially all of said inner shroud inner face.

13. The turbine vane assembly of claim 12, wherein:

said third plenum is disposed adjacent to said airfoil;

said third plenum having inlets allowing fluid communication between said outer endcap main coolant inlet port and said third plenum;

said airfoil having an outer surface and cooling passages extending adjacent to said outer surface; and said airfoil cooling passages in fluid communication with said third plenum and said fifth plenum.

14. The turbine vane assembly of claim 13, wherein:

said fifth plenum is in fluid communication with said outer endcap exhaust port; and said second plenum is in fluid communication with said outer endcap exhaust port.

15. The turbine vane assembly of claim 6, wherein:

said coupling of said outer endcap and said outer shroud forms a third plenum;

said coupling of said inner endcap to said inner shroud forms a fifth plenum;

said third plenum being adjacent to said airfoil;

said third plenum having inlets allowing fluid communication between said outer endcap main coolant inlet port and said third plenum;

said airfoil having an outer surface and cooling passages extending adjacent to said outer surface; and said airfoil cooling passages in fluid communication with said third plenum and said fifth plenum.

16. The turbine vane assembly of claim 15, wherein said fifth plenum is in fluid communication with said outer endcap exhaust port.

17. A combustion turbine comprising:

a compressor assembly;

a combustor Assembly;

a turbine assembly having a plurality of vane assemblies;

said vane assemblies comprising:

an outer endcap having a plurality of generally straight cooling passages and passage segments therethrough;

an inner endcap having a plurality of generally straight cooling passages and passage segments therethrough;

a vane casting having an outer shroud, an airfoil, and an inner shroud;

said outer shroud, airfoil and inner shroud each having a plurality of generally straight cooling passages and passage segments and wherein all said straight passages and passage segments are in fluid communication, wherein said airfoil cooling passages extend from said outer shroud to said inner shroud;

wherein said outer endcap is coupled to said outer shroud so that all said outer endcap cooling passages, said outer shroud cooling passages and airfoil cooling passages are in fluid communication; and said inner endcap is coupled to said inner shroud so that all said inner end cap cooling passages, said inner shroud cooling passages and airfoil cooling passages are in fluid communication.

18. The combustion turbine of claim 17, wherein:

said outer endcap is structured to form a plurality of outer shroud plenums when said outer end cap is coupled to said outer shroud; and said outer shroud plenums are in fluid communication with said outer endcap passages and said outer shroud passages.

19. The combustion turbine of claim 18, wherein:

said inner endcap is structured to form a plurality of inner shroud plenums when said inner end cap is coupled to said inner shroud; and said inner shroud plenums are in fluid communication with said inner endcap passages and said inner shroud passages.

20. The combustion turbine of claim 19, wherein said outer endcap includes a main coolant inlet port and at least one main coolant exhaust port.

21. The combustion turbine of claim 20, wherein said inner endcap includes a main coolant inlet port.

22. The combustion turbine of claim 21, wherein:

said airfoil includes a main coolant passage and at least one main exhaust passage;

said airfoil main coolant passage in fluid communication with said outer endcap main coolant inlet port;

said airfoil main coolant passage coupled to said inner endcap main coolant inlet port;

said airfoil at least one main exhaust passage in fluid communication with said outer endcap main exhaust port.

23. The combustion turbine of claim 22, wherein:

said coupling of said outer endcap to said outer shroud creates a first plenum, a second plenum, and a third plenum;

said plurality of outer endcap passages and passage segments includes a plurality of outer endcap first passages in fluid communication with said outer endcap main coolant inlet port and said first plenum;

said plurality of outer shroud passages and passage segments includes a plurality of outer shroud first passages, an edge plenum, a plurality of outer shroud second passages, and an inner face;

said plurality of outer shroud first passages in fluid communication with said first plenum and said outer shroud edge plenum;

said plurality of outer shroud second passages in fluid communication with said edge plenum and said second plenum, and extending along substantially all of said outer shroud inner face.

24. The combustion turbine of claim 23, wherein:

said plurality of outer endcap first passages each have a lip; and said lip structured to direct a portion of coolant from said outer endcap main coolant inlet port into said plurality of outer endcap first passages.

25. The combustion turbine of claim 24, wherein:

said coupling of said inner endcap to said inner shroud creates a fourth and fifth plenum;

said plurality of inner endcap passages and passage segments includes a plurality of inner endcap first passages in fluid communication with said inner endcap main coolant inlet port and said fourth plenum;

said plurality of inner shroud passages and passage segments includes a plurality of inner shroud first passages, an inner shroud edge plenum, a plurality of inner shroud second passages, and an inner face;

said plurality of inner shroud first passages in fluid communication with said fourth plenum and said inner shroud edge plenum; and said plurality of inner shroud second passages in fluid communication with said inner shroud edge plenum and said fifth plenum, and extending along substantially all of said inner shroud inner face.

26. The combustion turbine of claim 25, wherein:

said third plenum is disposed adjacent to said airfoil;

said third plenum having inlets allowing fluid communication between said outer endcap main coolant inlet port and said third plenum;

said airfoil having an outer surface and cooling passages extending adjacent to said outer surface; and said airfoil cooling passages in fluid communication with said third plenum and said fifth plenum.

27. The combustion turbine of claim 26, wherein:

said fifth plenum is in fluid communication with said outer endcap exhaust port; and said second plenum is in fluid communication with said outer endcap exhaust port.

28. The combustion turbine of claim 23, wherein:

said coupling of said inner endcap to said inner shroud creates a fourth and fifth plenum;

said plurality of inner endcap passages and passage segments includes a plurality of inner endcap first passages in fluid communication with said inner endcap main coolant inlet port and said fourth plenum;

said plurality of inner shroud passages and passage segments includes a plurality of inner shroud first passages, an inner shroud edge plenum, a plurality of inner shroud second passages, and an inner face;

said plurality of inner shroud first passages in fluid communication with said fourth plenum and said inner shroud edge plenum; and said plurality of inner shroud second passages in fluid communication with said inner shroud edge plenum and said fifth plenum, and extending along substantially all of said inner shroud inner face.

29. The combustion turbine of claim 28, wherein:

said third plenum is-disposed adjacent to said airfoil;

said third plenum having inlets allowing fluid communication between said outer endcap main coolant inlet port and said third plenum;

said airfoil having an outer surface and cooling passages extending adjacent to said outer surface; and said airfoil cooling passages in fluid communication with said third plenum and said fifth plenum.

30. The combustion turbine of claim 29, wherein:

said fifth plenum is in fluid communication with said outer endcap exhaust port; and said second plenum is in fluid communication with said outer endcap exhaust port.

31. The combustion turbine of claim 22, wherein:

said coupling of said outer endcap and said outer shroud forms a third plenum;

said coupling of said inner endcap to said inner shroud forms a fifth plenum;

said third plenum being adjacent to said airfoil;

said third plenum having inlets allowing fluid communication between said outer endcap main coolant inlet port and said third plenum;

said airfoil having an outer surface and cooling passages extending adjacent to said outer surface; and said airfoil cooling passages in fluid communication with said third plenum and said fifth plenum.

32. The combustion turbine of claim 31, wherein said fifth plenum is in fluid communication with said outer endcap exhaust port.

33. A method of constructing a turbine vane assembly comprising the steps:

(a) casting an outer endcap, an inner endcap, and a vane casting, said vane casting having an outer shroud, an airfoil and an inner shroud;

(b) drilling generally straight passages and passage segments in said outer endcap, inner endcap, and vane casting where said passages are structured to create a cooling circuit and an exhaust circuit;

(c) joining said outer endcap to said outer shroud, wherein said joining forms a plurality of outer shroud plenums between said outer endcap and said outer shroud wherein said outer shroud plenums are in fluid communication with the outer endcap plurality of passages and passage segments and the outer shroud plurality of passages and passage segments;

(d) joining said inner endcap to said inner shroud, wherein said joining forms a plurality of inner shroud plenums between said inner endcap and said inner shroud wherein the inner shroud plenums are in fluid communication with the inner endcap plurality of passages and passage segments and the inner shroud plurality of passages and passage segments.

34. The method of claim 33 further comprising the step of applying a series of coatings to said vane assembly.

35. The method of claim 34 wherein:

said passages are drilled using EDM drilling.

36. The method of claim 35 further including the steps of:

(a) cutting a plurality of openings in said outer shroud;

(b) cutting a plurality of openings in said inner shroud;

(c) providing a plurality of plugs structured to fit within said openings;

(d) inserting said plugs in said openings thereby forming an outer shroud edge plenum and an inner shroud edge plenum.

37. The method of claim 34 wherein:

said passages are drilled using ECM drilling.

38. The method of claim 37 further including the steps of:

(a) cutting a plurality of openings in said outer shroud;

(b) cutting a plurality of openings in said inner shroud;

(c) providing a plurality of plugs structured to fit within said openings;

(d) inserting said plugs in said openings thereby forming an outer shroud edge plenum and an inner shroud edge plenum.

* * * * *